US007114274B2

(12) United States Patent
Kobayashi et al.

(10) Patent No.: US 7,114,274 B2
(45) Date of Patent: Oct. 3, 2006

(54) IRONING APPARATUS

(75) Inventors: Shinichiro Kobayashi, Osaka (JP); Mamoru Ikeshima, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 52 days.

(21) Appl. No.: 10/892,146

(22) Filed: Jul. 16, 2004

(65) Prior Publication Data

US 2005/0016034 A1 Jan. 27, 2005

(30) Foreign Application Priority Data

Jul. 22, 2003 (JP) ..... 2003-277389
Jul. 22, 2003 (JP) ..... 2003-277391

(51) Int. Cl.
*D06F 75/40* (2006.01)

(52) U.S. Cl. ..... 38/96; 219/259

(58) Field of Classification Search ..... 38/77.6, 38/79, 96, 88, 107, 104, 82; 219/242, 246, 219/247, 254, 256, 259
See application file for complete search history.

(56) References Cited

U.S. PATENT DOCUMENTS 5,315,773 A * 5/1994 Iwami et al. ..... 38/77.6
5,802,749 A * 9/1998 Barmentlo et al. ..... 38/82
6,176,026 B1 * 1/2001 Leung ..... 38/96
6,233,853 B1 * 5/2001 Buchmann ..... 38/77.6
6,622,404 B1 * 9/2003 Valiyambath ..... 38/96

FOREIGN PATENT DOCUMENTS

| | | | |
|---|---|---|---|
| JP | 58-29498 | | 2/1983 |
| JP | 59-75099 | | 4/1984 |
| JP | 60-48799 | | 3/1985 |
| JP | 2-307500 | | 12/1990 |
| JP | 3-10900 | | 2/1991 |
| JP | 03-13997 | | 2/1991 |
| JP | 3-136699 | | 6/1991 |
| JP | 404354993 | A * | 12/1992 |
| JP | 404354995 | A * | 12/1992 |
| JP | 6-23200 | | 2/1994 |

* cited by examiner

*Primary Examiner*—Ismael Izaguirre
(74) *Attorney, Agent, or Firm*—McDermott Will & Emery LLP

(57) ABSTRACT

An ironing apparatus includes an iron body having a heater, a base, a tank, a water receiving port and a power receiving port, and a stand having an iron rest, a water feeding port and a power feeding part. The base is heated by the heater, and it comprises a vaporizing chamber. The tank stores water to be supplied to the vaporizing chamber. When the iron body is placed on the iron rest, the water feeding port is connected with the water receiving port of the iron body, and the power feeding part is connected electrically to the power receiving part of the iron body. During this moment, connection of the water receiving port to the water feeding port is completed prior to the connection between the power receiving part and the power feeding part.

17 Claims, 4 Drawing Sheets

IRONING APPARATUS

TECHNICAL FIELD

The present invention relates to an ironing apparatus provided with an iron body for smoothing out wrinkles from clothes, the ironing apparatus having facility of automatically supplying water to a tank inside the iron body by placing it on a stand.

BACKGROUND ART

A conventional ironing apparatus of a kind is provided with a stand having a water storage tank and an iron rest, and water is supplied into an iron body when the iron body is placed on the iron rest. This kind of ironing apparatus is disclosed in a publication of unexamined Japanese patent application, number H06-23200, for example.

In the ironing apparatus of such a structure, however, there is a case where a connection becomes loose between a valve mechanism (i.e., water receiving port) of the iron body and a water supply valve mechanism (i.e., water feeding port) of the stand. In that case, water leakage may occur between the valve mechanism of the iron body and the water supply valve mechanism of the stand when a water supply unit begins supplying water to the iron body. Water leakage may also occur between the valve mechanism of the iron body and the water supply valve mechanism of the stand before the water supply unit stops supplying the water. This causes a problem of wetting clothes, and leaves circular stains and the like on them. Or, it forces a user to take an extra time to dry the wet clothes. It also leads to a possibility of causing an electric leakage due to wetting of power feeding part of the stand and power receiving part of the iron body.

Furthermore, the water receiving port of the iron body needs to be aligned to the water feeding port of the stand when the iron body is placed on the stand. This detracts from convenience of use of the ironing apparatus. If there is a misalignment, however small, between the valve mechanism and the water supply valve mechanism, there occurs water leakage leading to the possibility of wetting the clothes and causing an electric leakage.

SUMMARY OF THE INVENTION

An ironing apparatus of the present invention includes an iron body having a heater, a base, a tank, a water receiving port and a power receiving part, and a stand having an iron rest, a water feeding port and a power feeding part. The base is heated by the heater, and it forms a vaporizing chamber. The tank stores water to be supplied to the vaporizing chamber. The water receiving port is communicated with the tank. The power receiving part is electrically connected with the heater. The iron rest holds the iron body. When the iron body is placed on the iron rest, the water feeding port is connected with the water receiving port of the iron body, and the power feeding part is connected electrically to the power receiving part of the iron body. During this moment, connection of the water receiving port to the water feeding port is completed prior to the connection between the power receiving part and the power feeding part. Because a water supply unit does not function unless the connection is completed between the water receiving port and the water feeding port, water is reliably supplied to the iron body. This invention can therefore avoid the clothes from wetting due to the water leakage between the water receiving port and the water feeding port, and prevent the problems of causing circular stains and forcing the user to spend time to dry the wet clothes.

DETAILED DESCRIPTION OF THE EXEMPLARY EMBODIMENT

Figure 1:
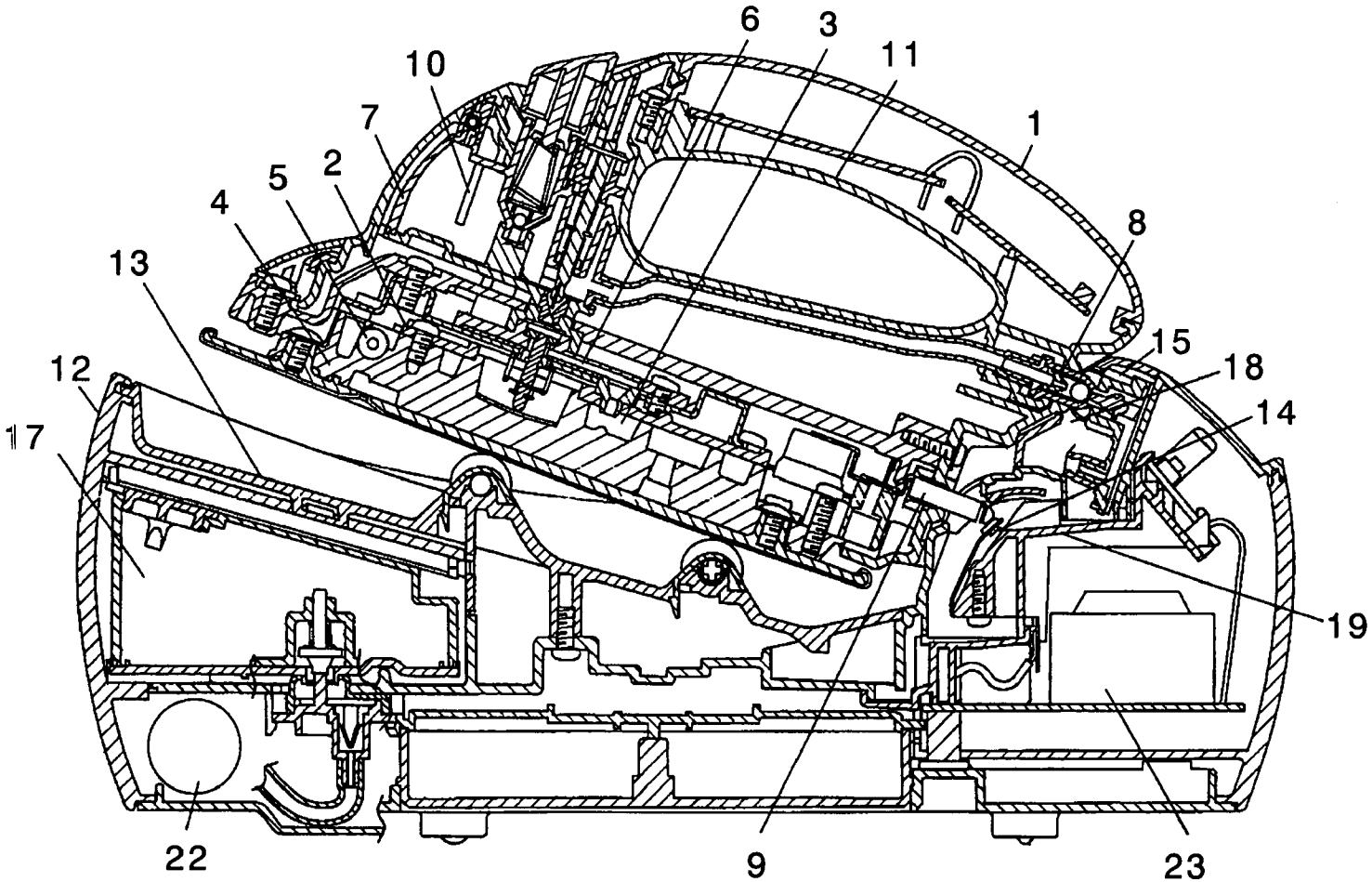
FIG. 1 is a longitudinal sectional view of an ironing apparatus according to an exemplary embodiment of the present invention.
Figure 2:
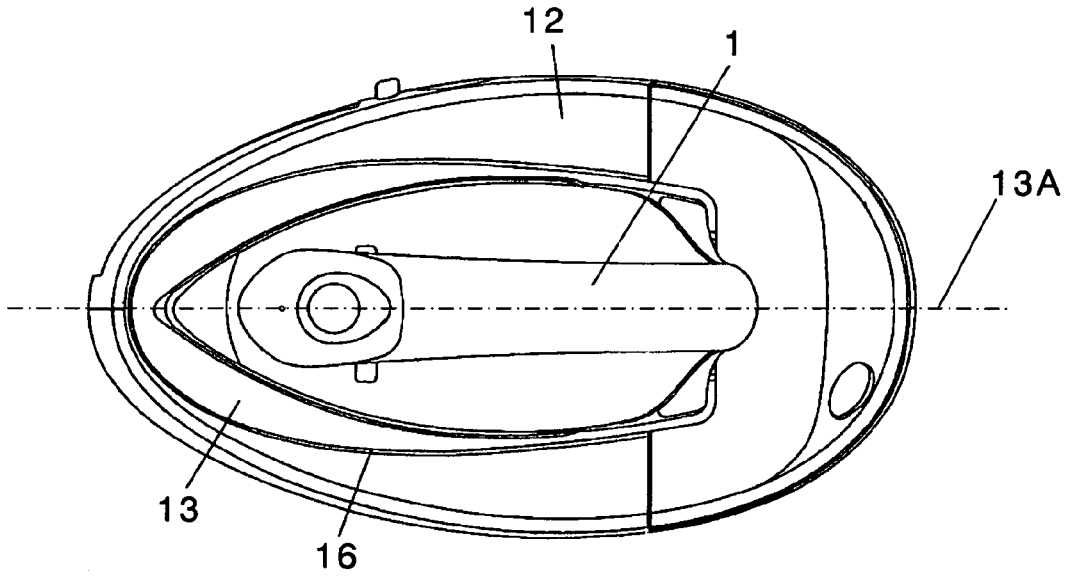
FIG. 2 is a plan view of the ironing apparatus shown in FIG. 1.
Figure 3:
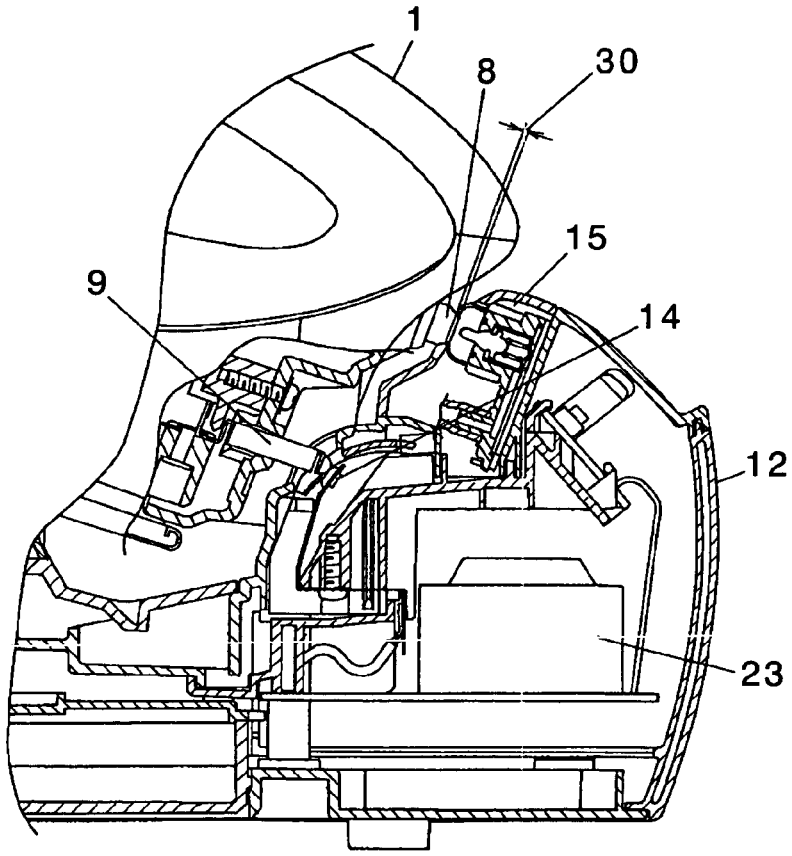
FIG. 3 is a partially sectioned view of the ironing apparatus shown in FIG. 1, illustrating a moment when an iron body is being placed on or removed from a stand.
Figure 4:
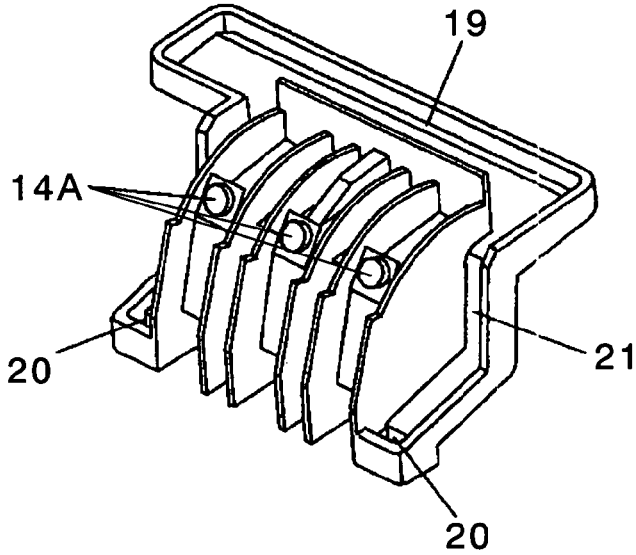
FIG. 4 is a perspective view of a water receiving port of the ironing apparatus shown in FIG. 1.
Figure 5:
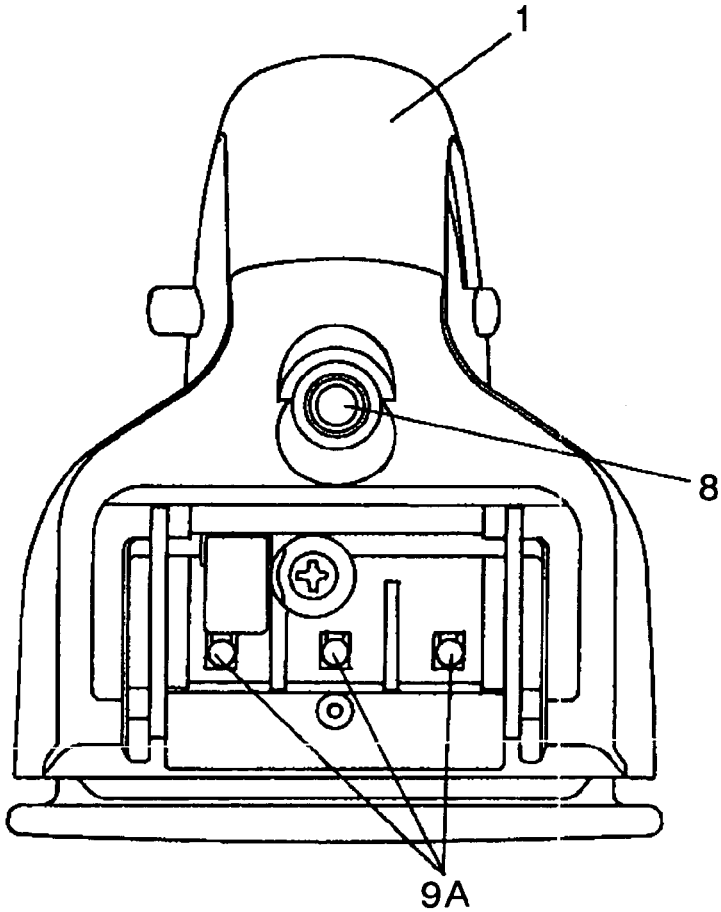
FIG. 5 is a rear view of the iron body of the ironing apparatus shown in FIG. 1.

FIG. 1 and FIG. 2 are a sectional view and a plan view respectively of an ironing apparatus according to the exemplary embodiment of this invention. FIG. 3 shows the ironing apparatus at a moment when iron body 1 is being placed on or removed from stand 12. FIG. 4 is a perspective view of a water receiving port, and FIG. 5 is a rear view of the iron body. The ironing apparatus has iron body 1 and stand 12.

Iron body 1 has base 4, heater 5, tank 7, and handle 11 for a user to hold iron body 1. Base 4 and cover plate 2 compose vaporizing chamber 3. Heater 5 is thermally connected to base 4, and heats up base 4. Tank 7 is in communication with vaporizing chamber 3 through water conduit 6. Water receiving port 8 supplies water to tank 7. Power receiving part 9 has power receiving terminals 9A, which are connected to heater 5. Water level detector 10 detects a water level inside tank 7. Water receiving port 8 is located above and rearward of power receiving part 9 in iron body 1 along a line extended in phantom toward a longitudinal direction of handle 11.

Stand 12 has iron rest 13, power feeding part 14, water feeding port 15, guide 16 and water storage tank 17. Iron rest 13 holds iron body 1 in a posture downwardly tilted toward the rear end of base 4. Power feeding part 14 has power feeding terminals 14A, which are connected individually with power receiving terminals 9A of iron body 1. In other words, power receiving part 9 comes into contact with power feeding part 14 when iron body 1 is placed on iron rest 13. Water feeding port 15 is located in a manner to confront water receiving port 8 of iron body 1, which is a position above and rearward of power receiving part 9 in alignment with centerline 13A of iron rest 13. Guide 16 is formed into a shape corresponding to the outer edge of iron body 1, and it guides the iron body 1 to a position where power receiving part 9 and water receiving port 8 confront power feeding part 14 and water feeding port 15 respectively when the user places iron body 1 on stand 12. That is, guide 16 of a graded shape is provided along the periphery of iron rest 13, and bounds on the sides of iron body 1. A space between guide 16 and iron body 1 in an orthogonal direction to centerline 13A of iron rest 13 narrows gradually toward the end where water feeding port 15 is located on stand 12.

Water receiving port 8, water feeding port 15, power receiving part 9 and power feeding part 14 are so constructed dimensionally that water receiving port 8 and water feeding port 15 maintain sealing margin 30 of a sufficient length necessary to ensure watertightness when making and breaking the connection between power receiving part 9 and power feeding part 14. In addition, at least one of water receiving port 8 and water feeding port 15 has a contacting portion made of an elastic material.

Water storage tank 17 stores water to be supplied to tank 7 in iron body 1 through water feeding port 15 and water receiving port 8. Opening 18 is provided under water feeding port 15. Water receptacle 19 is formed under the opening 18. Leader 21 is in communication with water receptacle 19 and drain hole 20 formed in the lower part of stand 12.

In addition, stand 12 also has water supply unit 22 and controller 23. Water supply unit 22 has a pump and the like, and it delivers the water stored inside water storage tank 17 to tank 7 in iron body 1 through water feeding port 15 and water receiving port 8. Controller 23 including electronic components controls electric supply to heater 5 and drives water supply unit 22.

Description is provided next of operation and function of the structure discussed above. When ironing, the user first places iron body 1 on iron rest 13 of stand 12, and turns on the power supply. Iron body 1 is guided by guide 16 in this moment so that water receiving port 8 of iron body 1 is brought to a position facing water feeding port 15 provided in stand 12, and connected to it. This completes the communicative connection between tank 7 inside iron body 1 and water storage tank 17 in stand 12.

Afterwards, power receiving part 9 and power feeding part 14 are connected when iron body 1 moves farther to rearward of sealing margin 30. When water level detector 10 sends a water level data to controller 23, controller 23 activates water supply unit 22. In other words, water supply unit 22 operates after water receiving port 8 and water feeding port 15 have secured a good extent of sealing margin 30 necessary for the watertight connection. Upon operation of water supply unit 22, the water inside water storage tank 17 is supplied to tank 7 in iron body 1 through water feeding port 15 and water receiving port 8. When a certain amount of water is supplied to tank 7 in iron body 1, water level detector 10 detects it and sends the data to controller 23, and controller 23 stops operating the water supply unit 22.

That is, water supply unit 22 does not operate unless connection is complete between water receiving port 8 and water feeding port 15, so as to ensure the reliable water supply. As a result, there is never a chance of water leakage between water receiving port 8 and water feeding port 15, which can lead to wetting of clothes and the like. In other words, the structure prevents problems of leaving circular stains and forcing the user to spend fruitless time to dry wet clothes, and thereby realizing the ironing apparatus which provides the user to make failure-free ironing with convenience to use.

When heater 5 becomes energized, it heats base 4 to a predetermined temperature under the control of controller 23. The user holds the iron body 1 when it reaches the predetermined temperature, and starts ironing clothes. When the user holds up the iron body 1 off the stand 12, power receiving part 9 is disconnected from power feeding part 14 prior to disconnection of water receiving port 8 from water feeding port 15. A proper length of sealing margin 30 is maintained during this moment for watertight connection between water receiving port 8 and water feeding port 15. That is, the watertight connection is ensured by sealing margin 30 between water receiving port 8 and water feeding port 15 when the water level data from water level detector 10 is interrupted and water supply unit 22 stops operating due to disconnection of power receiving part 9 from power feeding part 14.

When iron body 1 is lifted off stand 12, water receiving port 8 is disconnected from water feeding port 15 after water supply unit 22 stops operating as described above. Therefore, it can provide the like advantageous effect during this timing as in the case of placing the iron body 1 on the stand 12.

Figure 6A:
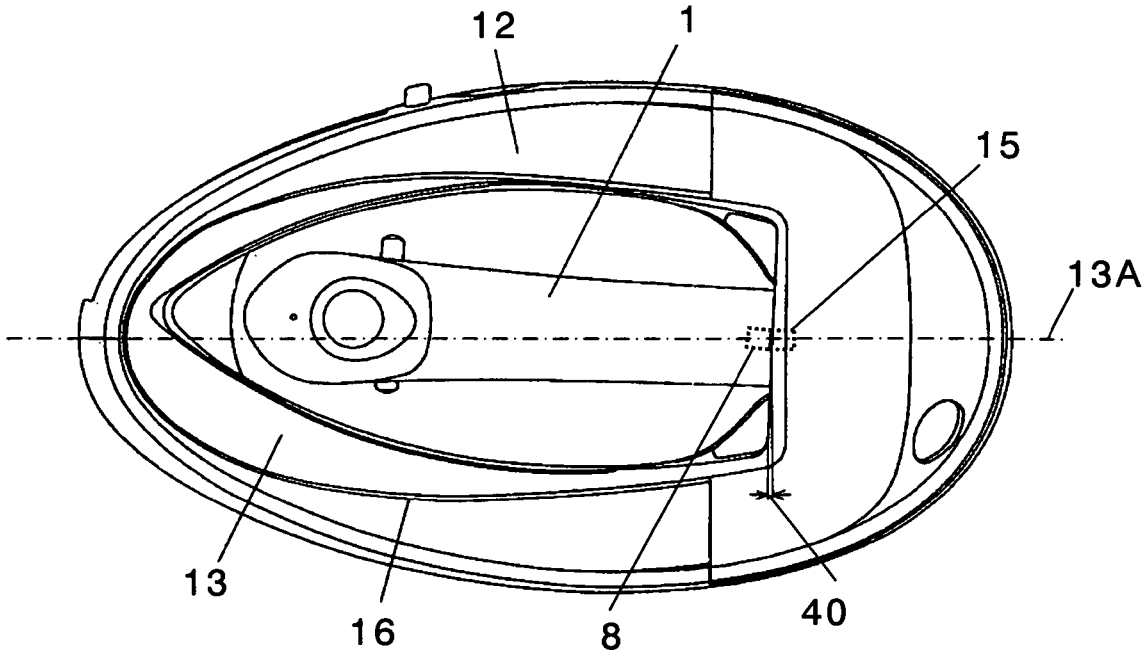
FIG. 6A and FIG. 6B are plan views illustrating resting positions of the iron body of the ironing apparatus shown in FIG. 1.
Figure 6B:
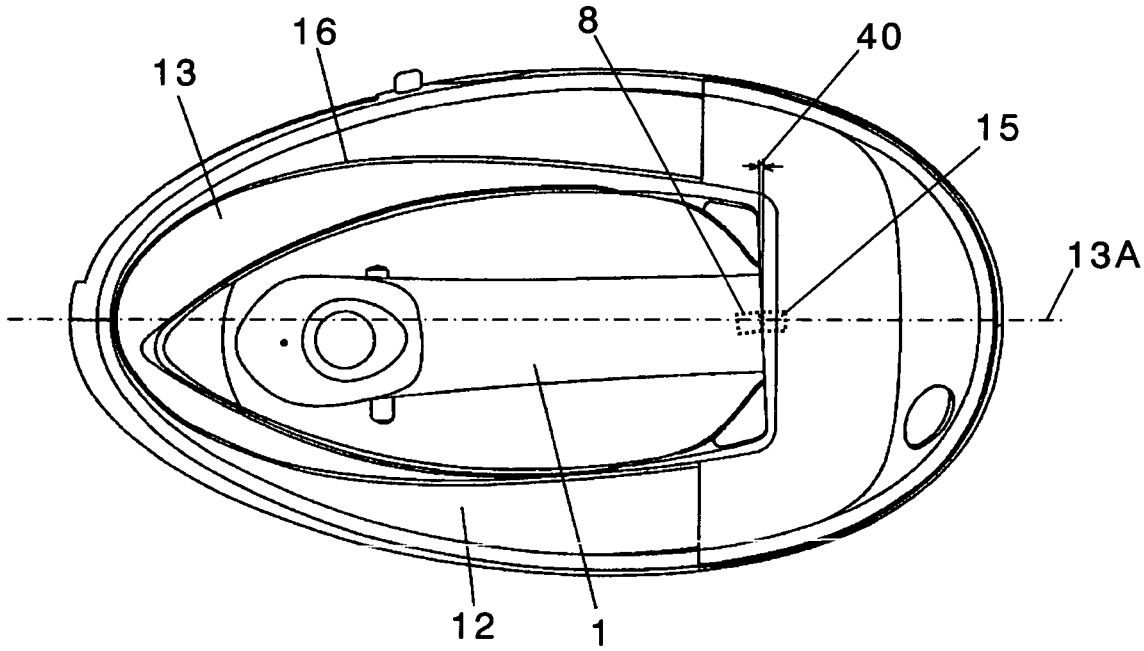

Description is provided next of a relation in dimensions between iron body 1 and guide 16. FIG. 6A and FIG. 6B are plan views illustrating resting positions of the iron body. A protruding portion at the rear end of handle 11 is deliberately omitted in FIG. 6A and FIG. 6B, in order to make it more comprehensible.

As discussed previously, guide 16 is provided on stand 12 along the outer edge of iron body 1, and it guides the iron body 1 to the position where water receiving port 8 confronts water feeding port 15. Therefore, the water is supplied while the user is not aware of it. In this structure, a certain space is necessary between the outer edge of iron body 1 and guide 16 so that the iron body 1 can be placed smoothly. Because of this space, there is a case that iron body 1 tilts in position with respect to guide 16. Whatever the case may be, it is more desirable that water feeding port 15 be located in the lateral center of iron rest 13 than it is at either the left side or the right side of the iron rest 13. This helps reduce gap 40 formed between water receiving port 8 and water feeding port 15 as shown in FIG. 6A and FIG. 6B. In other words, this structure ensures a sufficient length of sealing margin 30 between water receiving port 8 of iron body 1 and water feeding port 15 of stand 12, even if the user places iron body 1 in a tilting orientation with respect to guide 16. The user thus needs to pay no special attention for making the connection of water receiving port 8 to water feeding port 15 whenever iron body 1 is placed on stand 12, and thereby this structure provides the ironing apparatus with excellent usability and convenience.

It is also desirable that water receiving port 8 of iron body 1 is located at the center in a direction parallel to a line of power receiving terminals 9A, as shown in FIG. 5. According to this structure, iron body 1 is guided into a direction in which water receiving port 8 confronts water feeding port 15 when iron body 1 is placed on stand 12. The user can thus supply water to the iron without giving heed to it.

Moreover, it is desirable to provide opening 18 below the water feeding port 15, and even more desirable to provide water receptacle 19 in the vicinity of the opening 18 as described previously. It is further desirable that stand 12 is provided in its lower part with drain hole 20 in communication with any of opening 18 and water receptacle 19 through leader 21. Leader 21 and drain hole 20 compose a water draining structure.

Even if the water leaks by any chance due to a failure in any of water receiving port 8, water feeding port 15, and the like, the leaked water is collected through opening 18. In addition, provision of water receptacle 19 increases a receivable amount of the leaked water. Furthermore, the water is drained outside of stand 12 by way of drain hole 20 through leader 21. The structure prevents power receiving part 9, power feeding part 14 and controller 23 from being wet with the water, and obviates the risk of electric shock and malfunction, thereby enabling the user to attend to the ironing without any worries.

In this exemplary embodiment, although drain hole 20 is formed in the lower part of stand 12, like advantage can also be gained even if drain hole 20 is formed in the side surface of stand 12 underneath the water receptacle 19.

As previously stated, it is desirable that water receiving port 8 is located rearward of power receiving part 9 of iron body 1 along the line extended in phantom toward the longitudinal direction of handle 11. In other words, water receiving port 8 is preferably provided in the portion protruding beyond a plane where power receiving part 9 is located. This construction leads water to drip directly below, even if the water leaks by any chance from water receiving port 8 due to a failure and the like of it. This keeps the power receiving part 9 free from getting wet. The user can thus attend to the ironing without any worries even when the iron body 1 is energized again after it is placed on stand 12 again because it poses no risk of electric shock. In the structure of FIG. 1, although water receiving port 8 is located above the power receiving part 9, it may alternatively be disposed to a location below the power receiving part 9. However, water receiving port 8 can come into connection with water feeding port 15 prior to connection of power receiving part 9 to power feeding part 14, even when iron body 1 is brought to iron rest 13 at any angle with respect to its surface, if water receiving port 8 is located above the power receiving part 9. In the case of this structure, water feeding port 15 is provided above power feeding part 14 on stand 12, as a matter of course.

What is claim is:

1. An ironing apparatus comprising an iron body and a stand, the iron body having:

a heater;

a base heated by the heater, and forming a vaporizing chamber;

a tank storing water to be supplied to the vaporizing chamber;

a water receiving port communicated with the tank; and a power receiving part connected electrically with the heater, the stand having:

an iron rest for holding thereon the iron body;

a water feeding port to be connected with the water receiving port of the iron body when the iron body is placed on the iron rest; and a power feeding part to be connected electrically to the power receiving part of the iron body when the iron body is placed on the iron rest, wherein connection of the water receiving port to the water feeding port is completed prior to connection between the power receiving part and the power feeding part when the iron body is placed on the stand.

2. The ironing apparatus according to claim 1, wherein the water receiving port, the water feeding port, the power receiving part and the power feeding part are constructed dimensionally so that the water receiving port and the water feeding port maintain a sealing margin of a sufficient length necessary to ensure watertight connection when the power receiving part and the power feeding part come into connection.

3. The ironing apparatus according to claim 1, wherein the stand further has a guide for guiding the iron body to a position where the water receiving port and the power receiving part confront the water feeding port and the power feeding part respectively when the iron body is placed on the stand.

4. An ironing apparatus comprising an iron body and a stand, the iron body having:

a heater;

a base heated by the heater, and forming a vaporizing chamber;

a tank storing water to be supplied to the vaporizing chamber;

a water receiving port communicatively connected to the tank; and a power receiving part connected electrically with the heater, the stand having:

an iron rest for holding thereon the iron body;

a water feeding port to be connected with the water receiving port of the iron body when the iron body is placed on the iron rest; and a power feeding part to be connected electrically to the power receiving part of the iron body when the iron body is placed on the iron rest, wherein connection between the power receiving part and the power feeding part is separated prior to disconnection of the water receiving port from the water feeding port when the iron body is lifted off the stand.

5. The ironing apparatus according to claim 4, wherein the water receiving port, the water feeding port, the power receiving part and the power feeding part are constructed dimensionally so that the water receiving port and the water feeding port maintain a sealing margin of a sufficient length necessary to ensure watertight connection when the power receiving part and the power feeding part are disconnected.

6. The ironing apparatus according to claim 4, wherein the stand further has a guide for guiding the iron body to a position where the water receiving port and the power receiving part confront the water feeding port and the power feeding part respectively when the iron body is placed on the stand.

7. An ironing apparatus comprising an iron body and a stand, the iron body having:

a heater;

a base heated by the heater, and forming a vaporizing chamber;

a tank storing water to be supplied to the vaporizing chamber;

a water receiving port communicatively connected to the tank; and a power receiving part connected electrically with the heater, the stand having:

an iron rest for holding thereon the iron body;

a water feeding port provided in alignment with the centerline of the iron rest, and connected with the water receiving port of the iron body when the iron body is placed on the iron rest; and a power feeding part to be connected electrically to the power receiving part of the iron body when the iron body is placed on the iron rest.

8. The ironing apparatus according to claim 7, wherein the stand further has a guide for guiding the iron body to a position where the water receiving port and the power receiving part confront the water feeding port and the power feeding part respectively when the iron body is placed on the stand.

9. An ironing apparatus comprising an iron body and a stand, the iron body having:

a heater;

a base heated by the heater, and forming a vaporizing chamber;

a tank storing water to be supplied to the vaporizing chamber;

a power receiving part including power receiving terminals and connected electrically with the heater; and a water receiving port located at the center in a direction parallel to a line of the power receiving terminals, and communicated with the tank, the stand having:

an iron rest for holding thereon the iron body;

a water feeding port to be connected with the water receiving port of the iron body when the iron body is placed on the iron rest; and a power feeding part to be connected electrically to the power receiving part of the iron body when the iron body is placed on the iron rest.

10. The ironing apparatus according to claim 9, wherein the stand further has a guide for guiding the iron body to a position where the water receiving port and the power receiving part confront the water feeding port and the power feeding part respectively when the iron body is placed on the stand.

11. An ironing apparatus comprising an iron body and a stand, the iron body having:

a heater;

a base heated by the heater, and forming a vaporizing chamber;

a tank storing water to be supplied to the vaporizing chamber;

a water receiving port communicatively connected to the tank; and a power receiving part connected electrically with the heater, the stand having:

an iron rest for holding thereon the iron body;

a water feeding port to be connected with the water receiving port of the iron body when the iron body is placed on the iron rest;

a power feeding part to be connected electrically to the power receiving part of the iron body when the iron body is placed on the iron rest; and an opening under the water feeding port to allow drainage of water from said water feeding port.

12. The ironing apparatus according to claim 11, wherein the stand further has a water draining structure communicated with the opening.

13. The ironing apparatus according to claim 11, wherein the stand further has a water receptacle in the vicinity of the opening.

14. The ironing apparatus according to claim 13, wherein the stand further has a water draining structure communicated with any of the opening and the water receptacle.

15. The ironing apparatus according to claim 11, wherein the stand further has a guide for guiding the iron body to a position where the water receiving port and the power receiving part confront the water feeding port and the power feeding part respectively when the iron body is placed on the stand.

16. An ironing apparatus comprising an iron body and a stand, the iron body having:

a heater;

a base heated by the heater, and forming a vaporizing chamber;

a tank storing water to be supplied to the vaporizing chamber;

a power receiving part connected electrically with the heater; and a water receiving port provided in a portion protruding beyond a plane where the power receiving part is located, and communicated with the tank, the stand having:

an iron rest for holding thereon the iron body;

a water feeding port to be connected with the water receiving port of the iron body when the iron body is placed on the iron rest;

a power feeding part to be connected electrically to the power receiving part of the iron body when the iron body is placed on the iron rest, a guide for guiding the iron body to a position where the water receiving port and the power receiving part confront the water feeding port and the power feeding part respectively when the iron body is placed on the stand, said guide being provided along the periphery of the iron rest.

17. The ironing apparatus according to claim 16, wherein the water receiving port is located above the power receiving part.

* * * * *